United States Patent [19]

Kalnin et al.

[11] 3,976,395

[45] Aug. 24, 1976

[54] MULTIPLE-STAGE CENTRIFUGAL COMPRESSOR

[76] Inventors: Igor Martynovich Kalnin, Ulitsa Kropotkinskaya, 26, kv. 13; Beniamin Lvovich Tsirlin; Elena Zalmanovna Bukhter, both of 9 Parkovaya ulitsa, 32, kv. 24; Alexandra Dmitrievna Terenina, ulitsa Argunovskaya, 18, kv. 120; Galina Ivanovna Eremkina, ulitsa Gvardeiskaya, 5, korpus 1, kv. 22, all of Moscow; Andrei Ivanovich Poteiko, ulitsa Studencheskaya, 17, kv. 48; Khanon Yakovlevich Breslov, ulitsa Novatorov, 7, kv. 10, both of Kazan, all of U.S.S.R.

[22] Filed: Sept. 12, 1975

[21] Appl. No.: 613,022

[52] U.S. Cl. ..... 415/199 A; 415/219 C; 415/170 A

[51] Int. Cl.[2] ..... F04D 29/42; F04D 17/00

[58] Field of Search ..... 415/198, 108, 199 A, 415/219 C, 170 A

[56] References Cited

UNITED STATES PATENTS

| | | | |
|---|---|---|---|
| 3,427,000 | 2/1969 | Scalzo | 415/108 |
| 3,809,493 | 5/1974 | Pilarczyk | 415/199 A |
| 3,927,763 | 12/1975 | Strub et al. | 415/199 A |

FOREIGN PATENTS OR APPLICATIONS

| | | | |
|---|---|---|---|
| 123,153 | 1/1947 | Australia | 415/108 |
| 391,413 | 8/1908 | France | 415/199 A |
| 17,283 | 1915 | United Kingdom | 415/108 |
| 606,947 | 8/1948 | United Kingdom | 415/108 |
| 838,317 | 1/1960 | United Kingdom | 415/199 A |
| 1,250,041 | 10/1971 | United Kingdom | 415/108 |

*Primary Examiner*—Henry F. Raduazo
*Attorney, Agent, or Firm*—Haseltine, Lake & Waters

[57] ABSTRACT

A multiple-stage centrifugal compressor without a horizontal joint wherein the stator consists of a package of interconnected diaphragms with cylindrical holes for the installation of the labyrinth seal holders. The cylindrical holes vary in diameter along the longitudinal axis of the compressor, said diameter increasing in steps towards end of the diaphragm package.

2 Claims, 6 Drawing Figures

FIG. 1

MULTIPLE-STAGE CENTRIFUGAL COMPRESSOR

The present invention relates to the compressor-building industry and more particularly it relates to multiple-stage centrifugal compressors.

By the multiple-stage centrifugal compressor is meant a machine with two or more impellers mounted on a common shaft and accommodated in a single casing.

The multiple-stage centrifugal compressors are employed in all cases when it is impossible to obtain the required head in a single stage or when it is impracticable because in a number of cases the single-stage machines are less economical than the multiple-stage ones.

Among the common applications of the centrifugal compressor according to the present invention are compression of air and various gases in chemical, petrochemical and gas industries, including conveyance of gas in trunk gas lines, and compression of refrigerant vapours in large refrigerating plants, e.g. for air conditioning in industry and in public buildings.

Another possible application of the centrifugal compressor design according to the present invention is its employment for multiple-stage centrifugal pumps which have many structural elements in common with the centrifugal compressors.

Such pumps are used for pumping various liquids, e.g. water, acids, alkalies and petroleum products.

Known at present are three different types of multiple-stage centrifugal compressors.

The most commonly used type has a horizontallly-split casing and a horizontal joint in each diaphragm inside the casing, said diaphragms forming the flow duct in the stator of the multiple-stage centrifugal compressor. The labyrinth seals installed in the diaphragms of such compressors also have horizontal joints. Their rotor is constituted by a shaft which mounts the impellers of the compressor stages. In this type of compressors the rotor is installed on bearings located in the lower half of the casing. During assembly, the lower half of the compressor is covered by the upper half with the diaphragms. Both halves of the compressor are bolted together along the joint. The joint is sealed either with a gasket placed between the flanges of the upper and lower casing halves, or with sealing compounds applied to the flanges of the horizontal joint, or else by virtue of a high surface finish (for example by scraping) of the jointing surfaces without the use of sealing gaskets or compounds. The last type of sealing is used mainly in compressors intended to compress air, nontoxic and incombustible cheap gases.

This compressor is employed most widely for the low and medium range of pressures (up to 40 kgf/cm$^2$) in the compressor casing and is characterized by a high metal content owing to the provision of heavy rigid flanges required for the bolted horizontal joint between the compressor halves. Besides, this type of compressors is characterized by:

difficulties in accurate matching of the surfaces of the casing joint, diaphragms and labyrinth seals installed in said diaphragms;

a high cost of assembly work caused by complicated operations involved in sealing the horizontal joints of the diaphragms and labyrinth seals;

a higher manufacturing cost of the diaphragms and labyrinths with horizontal joints;

possibility of warping of the casing, diaphragms and labyrinth seals caused by the presence of the joint, i.e. by the open semicircular shape of these parts, said warping arising due to thermal deformations during compressor operation;

a lower efficiency due to leakage of gase between the compressor stages because of either an inferior quality of sealing of the horizontal joint, or of possible warping.

Also known in the present art is a multiple-stage centrifugal compressor whose casing has no horizontal joint (the so-called "barrel-type" compressor). The casing of this compressor accommodates a stator consisting of a package of interconnected diaphragms. The diaphragms have a horizontal joint. The rotor constituted by a shaft with impellers is installed on bearings which are mounted in the casing and inside the stator. The lower and upper halves of the stator have cylindrical holes receiving the labyrinth seal holders. The diaphragms are provided with internal channels which, together with the rotor impellers, form the flow duct of the compressor.

During compressor assembly the rotor is installed into the stator and the joint of both halves of the diaphragms is tightened by bolts located near the outside diameter of the diaphragms. This forms a single package of diaphragms with the rotor located inside. Then the rotor with the diaphragms is installed in the casing on bearings.

This design is used in making various modifications of multiple-stage centrrifugal compressors intended for operation at high pressures (above 40 kgf/cm$^2$) and manufactured by a number of European and American firms.

This type of the multiple-stage centrifugal compressor has no disadvantages ensuing from the provision of the horizontal joint of the casing but retains all the above-listed disadvantages caused by the presence of this joint in the diaphragms and labyrinth seals.

Besides, if such a compressor has to be disassembled for inspecting or repairing some elements of its rotor or stator which are most likely to get worn or damaged in operation, e.g. labyrinth seals, it must be completely disassembled which involves considerable difficulties. First the package of assembled diaphragms has to be moved out of the casing and only after that the diaphragms have to be disassembled for removing the rotor. This will call also for the removal of the sealing rings (usually rubber ones) which are placed in the grooves along the outside diameter of the diaphragms and intended to prevent leaks of the compressed fluid from a high-pressure stage to a low-pressure stage along the inside diameter of the casing. As a rule, the removed rings cannot be reused and have to be replaced by new ones.

Thus, repairs or inspections of this type of compressor call for difficult operations, i.e. removal of the heavy diaphragm package with the rotor out of the casing and replacement of rubber sealing rings.

The removal of the diaphragm package requires the use of special equipment and appliances.

For example, the firm Demag (Federal Republic of Germany) installs special rail tracks near the centrifugal compressor for rolling out the diaphragm package. The firm Rato (France) facilitates this operation by providing the diaphragms with rollers which reduce resistance to friction during the movement of the diaphragm package in the casing.

All operations relates to inspections and preventive repairs of multiple-stage centrifugal compressors for the replacement of worn parts require additional time spent for such difficult operations as wremoval and disassembly of the diaphragm package. Besides, these operations require additional capital expenses for providing special appliances intended to facilitate disaassembly.

A well-known third type of the multiple-stage centrifugal compressor has no horizontal joint. Its casing accommodates a stator consisting of a package of interconnected diaphragms, and a rotor in the form of a shaft with impellers installed on it. The diaphragms have cylindrical holes receiving the holders of the labyrinth seals, and internal channels which, together with the impellers, form the flow duct of the compressor. The diaphragms and labyrinth seals have no horizontal joints. The holes in the diaphragms for the labyrinth holders have the same diameter along the shaft axis.

A characteristic feature of this multiple-stage centrifugal compressor lies in that during its assembly the rotor and stator are assembled outside the casing by consecutive mounting of the impellers on the shaft and by placing a corresponding integral diaphragm and the labyrinth seal holder with the seal after each impeller.

After installing all the impellers on the shaft and putting the diaphragms in position, the latter are bolted together. The bolts are located near the outside diameter of the diaphragms and positioned horizontally, parallel with the rotor axis.

Thus, the multiple-stage centrifugal compressor of this type has only vertical joints along the diaphragm surfaces.

The fully assembled diaphragm package with the rotor is installed in the casing of the multiple-stage centrifugal compressor. Such multiple-stage centrifugal compressors are used mainly for high pressure applications, for instance for the cirxulation of the nitrogen-hydrogen mixture in synthesis of ammonia (pressures of 200–400 kgf/cm$^2$ and higher).

This type of the multiple-stage centrifugal compressor is favourably distinguished (from the above-mentioned compressor type) by a considerable simplification and cheapening of its manufacture. However, repairs of the compressors with integral casings are complicated because removal of the rotor from the casing calls for taking out the diaphragm package with the rotor after which the stator and rotor have to be disassembled in succession.

This disassembly becomes particularly complicated if the impellers are shrunk on the shaft.

The above disadvantages of the "barrel-type" compressors with integral casings resulted in that they are currently used almost exclusively for building multiple-stage centrifugal compressors working at high pressures. In this case the absence of the horizontal joint of the casing justifies the difficulties and high costs of manufacture and difficulties of disassembly and installation in service.

The design of the multiple-stage centrifugal compressors used for circulation of the nitrogen-hydrogen mixture in synthesis of ammonia has a number of similarities with the sectional centrifugal pumps. However, the latter have no outer casing whose function is fulfilled by the diaphragm-sections whose outside diameter forms a casing which is subjected to pressure and has as many vertical joints, perpendicular to the shaft axis, as there are pump stages. However, reliable sealing of the joints between the diaphragms of the individual pump sections is ensured because the pumps of this type work at relatively low pressures, usually not higher than 100 kgf/cm$^2$ and because the sealed fluid is not gas but liquid.

An object of the present invention is to provide a design of the multiple-stage centrifugal compressor which would utilize the advantages inherent in the casings, diaphragms and labyrinth seals having no horizontal joints.

Another object of the present invention is to provide a design of the multiple-stage centrifugal compressor which would be practicable for any range of pressures.

Still another object of the present invention is to provide a technologically-simple and cheap design of the multiple-stage centrifugal compressor.

A further object of the present invention is to provide a design of the multiple-stage centrifugal compressor which would simplify and cheapen the work involved in inspecting and repairing it in operation.

Among the other objects of the present invention we can note the possibility of canceling the fitting operations in the manufacture of the multiple-stage centrifugal compressor.

And the last object of the invention is to provide a design of the multiple-stage centrifugal compressor ensuring interchangeability of all its units and parts.

The main object of the invention is to provide a design of the multiple-stage centrifugal compressor wherein the cylindrical compressor wherein the cylindrical holes in the diaphragms for mounting the labyrinth seal holders would have a diameter allowing the rotor and labyrinth seals to be disassembled without removing the diaphragm package from the compressor casing.

In accordance with these and other objects, the essence of the present invention resides in providing a multiple-stage stage centrifugal compressor without a horizontal joint whose stator consists of a package of interconnected diaphragms with cylindrical holes receiving the labyrinth seal holders wherein, according to the invention, the cylindrical holes in the diaphragms for mounting the holders have different diameters along the longitudinal axis of the compressor, said diameters increasing in steps towards the end of the diaphragm package.

This design of the multiple-stage centrifugal compressor utilizes the advantages inherent in the designs of the casings, diaphragms and labyrinth seals without horizontal joints, namely, a 25 – 30% decrease in the metal content due to the absence of the cumbersome flange joint along the horizontal surface, absence of sealing operations and warping of the jointing elements, simplification of manufacturing technology and a 15 – 25% reduction in the manufacturing cost due to omission of the additional operations related to machining the surfaces of the horizontal joint of the stator parts (diaphragms and labyrinth seals); a 2% increase in efficiency due to absence or leaks of the compressed fluid between the stages with different pressures; efficient employment at any pressure levels.

A considerable simplification of operation and reduction in the manufacturing cost makes the design of the multiple-stage centrifugal compressor according to the invention efficient not only for high pressures but also for operation at different pressure levels, for example in refrigerating machines where pressuretightness is of prime importance.

The diaphragms in the design according to the invention are machined as a whole which dispenses with the complicated operation intended to match the jointing surface of the diaphragm with its diametrical surface and with the similar surface for jointing the halves of the casting of the multiple-stage centrifugal compressor. Besides, the reduction in the manufacturing cost is achieved by a smaller amount of manual work during assembly. This compressor is more reliable in operation and the time between successive repairs is doubled because all the disassembly work required in the course of service can be carried out without removing the heavy unit - diaphragm package - or, at any rate, the number of such disassembly operations can be reduced only to the extent required for replacing the sealing rings made of rubber or other materials.

If replacement of rings is unnecessary, the diaphragm package can remain in the casing throughout the entire life of the compressor.

The interrepair intervals increase also due to absence of warping of the stator parts which have a closed shape ensuring perfect axial alignment of the rotor shaft bearings.

The outer casing without the horizontal joint either improves pressuretightness considerably or makes it complete.

The related to inspections and repairs of the compressor according to the invention is simplified and made cheaper by 50 – 60% since the wearing parts can be disassembled and assembled without removing the diaphragm package out of the casing. The rotor and labyrinth seals are disassembled and assembled inside the compressor casing by successive removal of the impellers from the shaft and of the corresponding labyrinth holders or other stator elements, for example guide vane assemblies.

As the parts that can be removed without disassembly of the diaphragm package are separated from the diaphragm located at the end of the package, the mounting diameters of these parts in the corresponding diaphragms become smaller and smaller. Thus it becomes possible to remove the parts freely through the recesses in the diaphragms located nearer to that end of the package from which the disassembly or assembly operations are started.

Depending on the number of stages in the casing (usually not more than six), the package can be disassembled either from one or both ends.

In the latter case the diameters of the recesses will be smallest in the diaphragms located in the middle of the casing while the two end diaphragms (at both ends) will have recesses with the largest diameters.

The disassembly work does not require erection of special appliances for removal of the diaphragm package in the compressor rooms which reduces capital expenses 10 – 15%.

The axial alignment of all the cylindrical surfaces of the diaphragms in the design according to the invention is ensured by the accuracy of machining which dispenses with the need for manual fitting work. This improves the accuracy of assembly, substituting the subjective estimates of the assembly operator by the precision standards of the machines, and ensures interchangeability of all the units and parts.

It is practicable that the hole for the labyrinth seal holder located along the shaft axis in the middle of the diaphragm package should have the smallest diameter while all the other holes for the labyrinth seal holders should have diameters increasing in steps towards both ends of the diaphragm package.

Such a design of the labyrinth seal holders allows the multiple-stage centrifugal compressor to be disassembled for replacing the wearing parts without removal of the diaphragm package and allows the diaphragms to be made without the horizontal joint.

The rotor is made dismountable which means that the impellers are installed on splines or in some other movable way and can be taken off the shaft. One of the impellers can be mounted on a tight, e.g. shrinkage fit.

The above advantages of the compressor design according to the invention also give ground to recommend its use in centrifugal pumps intended to pump mostly nonaggressive and noncorrosive fluids which do not produce deposits interfering with disassembly of the pump rotor inside the casing.

Other objects and advantages of the invention will become apparent from the examples of its embodiment described below (with reference to the accompanying drawings, in which.

The multiple-stage centrifugal compressor without the horizontal joint according to the invention comprises a casing 1 (FIG. 1), accommodating a stator 2 and a rotor 3.

Figure 1:
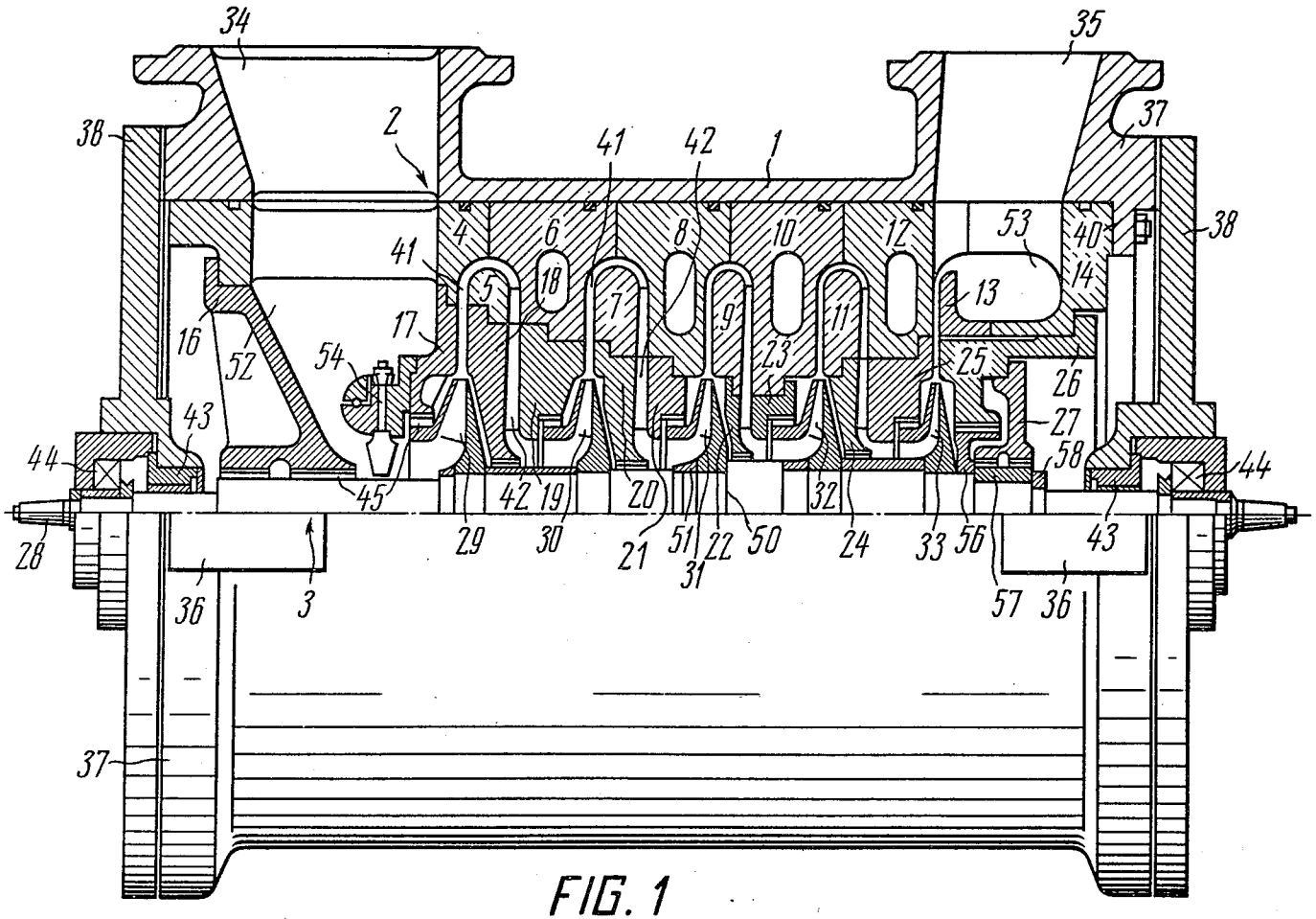
FIG. 1 is a schematic longitudinal section through a five-stage centrifugal compressor according to the invention.
Figure 2:
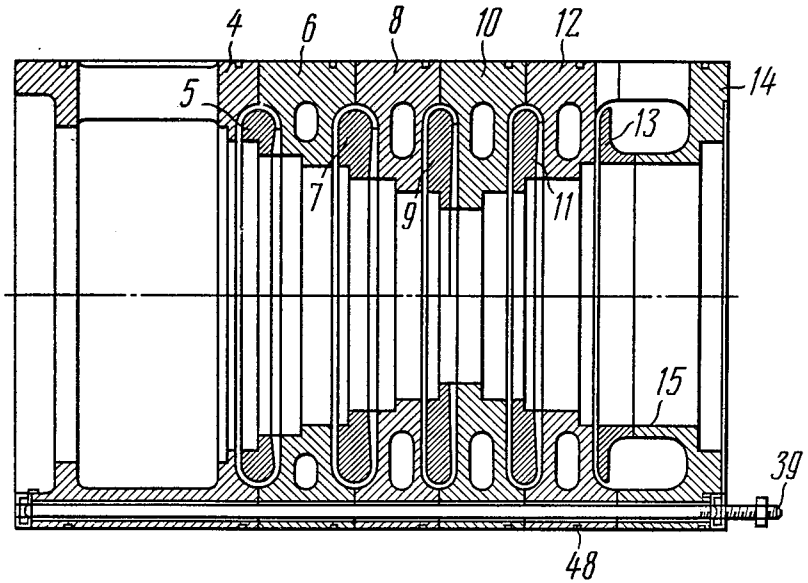
FIG. 2 is a longitudinal section through the diaphragm package of the five-stage centrifugal compressor according to the invention.

The stator 2 consists of a package of interconnected diaphragms 4, 5, 6, 7, 8, 9, 10, 11, 12, 13, 14 which have cylindrical holes 15 (FIG. 2) to receive holders 16 (FIG. 1), 17, 18, 19, 20, 21, 22, 23, 24, 25, 26, 27. The diameter of the holes 15 (FIG. 2) varies along the compressor axis and increases in steps towards the ends of the diaphragm package 4 – 14. Usually, the hole 15 intended to receive the holders 11, 13 (FIG. 1) and located in the middle of the diaphragm package 4 – 14 has the smallest diameter while the other holes 15 (FIG. 2) have diameters increasing in steps towards both ends of the diaphragm package 4 – 14 (FIG. 1). The rotor 3 consists of a shaft 28 mounted with impellers 29, 30, 31, 32, 33 of the compressor stages. The centrifugal compressor casing 1 has the form of a hollow cylinder with a suction connection 34 and a discharge connection 35 and is provided with supports 36 to fasten it to the rame (not shown in the drawing) and flanges 37 to fasten covers 38 closing the compressor from the ends. The stage diaphragms 4 – 14 are interconnected by tie bolts 39 (FIG. 2). The diaphragm package is fixed in the axial direction by fastening it to the inner flange 40 (FIG. 1) of the casing 1. The spaces of the stage diaphragms 4 – 14 together with holders 16 – 27 form a space accommodating the shaft 28 with the impellers 29–33 which, together with the diffusers and back guide vane assemblies 42 form the flow duct of the compressor. Each end cover 38 of the casing 1 is provide with a bearing 43 for supporting the shaft 28. The point where the shaft 28 protrudes from the casing 1 is sealed by a gland 44 or by a labyrinth seal.

The impellers 29 – 33 and the shaft 28 are provided with labyrinth seals 45 which prevent the compressed gas from flowing from a high-pressure stage to the stage with a lower pressure.

Figure 3:
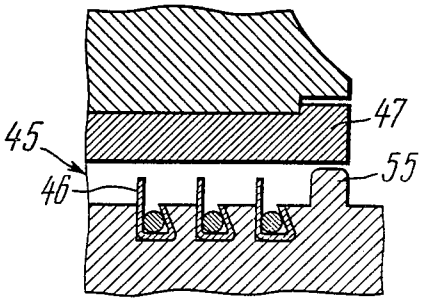
FIG. 3 shows the labyrinth seal, enlarged.

Each labyrinth seal 45 is formed by knife edges 46 (FIG. 3) mounted on the impellers 29 – 33 (FIG. 1) and on the shaft 28, and by bushings 47 (FIG. 3) so that only a very small clearance (0.1 – 0.15 mm) is left between the outside radius of the knife edges 46 on the parts of the rotor 3 and the inside radius of the bushing 47. The bushings 47 of the labyrinth seals 45 are enclosed in holders 16 – 27 (FIG. 1). The diaphragms of the stages 4 – 14 are provided with cylindrical holes 15 (FIG. 2) for the holders 16 – 27 (FIG. 1) whose diameter varies along the axis of the shaft 28, increasing in steps towards the ends of the diaphragm package. Usually, the hole 15 (FIG. 2) for the holders 22 – 23 located along the axis of the shaft 28 (FIG. 1) in the middle of the diaphragm package 4 – 14 has the smallest diameter while all the other holes 15 (FIG. 2) have diameters increasing in steps towards both ends of the diaphragm package 4 – 14 (FIG. 1). The holders 16 – 27 of the labyrinth seals 45 (FIG. 3) are fixed in the cylindrical holes 15 (FIG. 2) inside the diaphragms 4 – 14. In this design of the centrifugal compressor the labyrinth bushings 47 (FIG. 3) as well as the holders 16 – 27 (FIG. 1) of the labyrinth seals 45 (FIG. 3) and diaphragms 4 – 14 (FIG. 1) In this design of the centrifugal compressor have no horizontal joints.

Therefore, the number of the joints to be sealed is considerably reduced here, though sealing of the individual joints is of major importance. This applies in the first place to the clearance between the compressor casing 1 and the diaphragm package 4 – 14.

Individual zones along the axis of the centrifugal compressor are subjected to different pressures.

Figure 4:
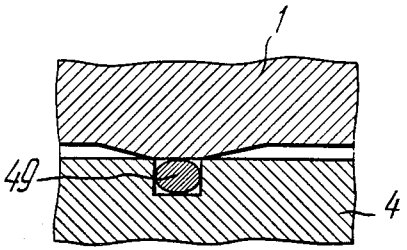
FIG. 4 shows the seal of the joint between the casing and diaphragm package, enlarged.

To prevent the gas from flowing through the gap between the inner surface of the compressor casing 1 and the outer surface of the diaphragm package 4, 6, 8, 10, 12, 14, these diaphragms are provided with grooves 48 (FIG. 2) accommodating sealing rings 49 (FIG. 4). These rings 49 seal the joint between the individual parts of the casing 1 in the axial direction, i.e. they prevent the gas from leaking from the discharge to the suction side through the gap between the diaphragms 4, 6, 8, 10, 12, 14 (FIG. 1) and the recess in the casing 1.

The sealing rings 49 (FIG. 4) can be circular in cross-section or have another configuration.

The materials used for making the sealing rings are various kinds of rubber, fluorinated plastics and other polymers selected to suit the properties of the gas compressed in the centrifugal compressor.

The rotor 3 (FIG. 1) of the centrifugal compressor is of the dismountable construction. For this purpose the impellers 29, 30, 32, 33 are secured on the shaft 28 in a movable way, e.g. on splines and can, therefore, be easily removed.

One of the impellers 31 is rigidly fixed, for example by shrinking. This impeller 31 is fixed axially by a shoulder 50 on the shaft 28 at one side of the impeller and by a bushing 51 expanded on the shaft 28 at the other. Axial fixing can also be achieved by other methods, for example by installing a pin into the bushing of one of the impellers (not shown in the drawing).

Rigid fixing of one of the impellers, e.g. 31, on that shaft 28 is not an imperative requirement. It is also possible to install all the impellers 29 –33 on splines, though spline mounting is not the only possible method of impeller installation either.

Other types of movable joints can be, for example, key joints with axial locking, mounting on tapers and tightening with nuts, press-fitting with hydraulic stretching of the impeller bushing during installation on, or removal from, the shaft (not shown in the drawings).

In the multiple-stage centrifugal compressor the gas is compressed while it flows from the suction connection 34 to the discharge connection 35 consecutively through all the five comprssion stages.

The flow duct of the compressor also includes the suction chamber 52 located before the 1st stage and the accumulating chamber (or volute) 53 after the last stage of the centrifugal compressor. Located at the entry into the 1st stage is a device 54 for controlling the capacity of the centrifugal compressor.

Assembly sequence of the multiple-stage centrifugal compressor.

The diaphragms 4 – 14 (FIG. 2) are assembled into a package with the aid of tie bolts 39. The assembled package is machined over the outside diameter of the diaphragms 4, 6, 8, 10, 12 and 14 and over the inside diameter of the hole 15. Then sealing rings 49 (FIG. 4) are put on the assembled package, the holders 22 and 23 (FIG. 1) are inserted and secured as required after which the package is placed into the casing 1 of the centrifugal compressor.

After installing the package and fixing it to the flange 40 of the casing 1 with the aid of bolts 39 (FIG. 2), the shaft 28 with the impeller 31 is put in position. To prevent the shaft 28 from cocking because the bearings 43, have not yet been installed and from damaging the labyrinth seals 45, it has bands 55 (FIG. 3) whose diameter is somewhat higher (0.05 – 0.1 mm) than the outside diameter of the knife edges 46 of the labyrinth seal 45.

One of these bands 55 is located at the point of the holder 22 (FIG. 1) of the labyrinth seal 45 (FIG. 3) which has been installed in the package in advance. Besides, one of the ends of the shaft 28 (FIG. 1) is supported by a special device. At this stage the assembly operations are carried out at the other end.

When the supporting device is placed, say, at the right-hand side, then installation of the shaft 28 is followed by successive mounting of the holders 21, 20, 19, 18, 17, 16 alternately with the impellers 30, 29 and device 54 for compressor capacity control.

Next, the cover 38, the left-hand bearing 43 and the gland seal 44 are installed. The shaft 28 is also provided with a protruding band 55 (FIG. 3) under the holder 16.

After installation of the left-hand bearing 43 (FIG. 1) the supporting device is withdrawn and the following parts are mounted in the consecutive order: impellers 32, 33, dummy piston 56, bushing 57 and nut 58, holders 24, 25, 26, 27. Then are installed the cover 38, right-hand bearing 43, gland seal 44. The disassembly is carried out by reversing the assembly operations.

Figure 5:
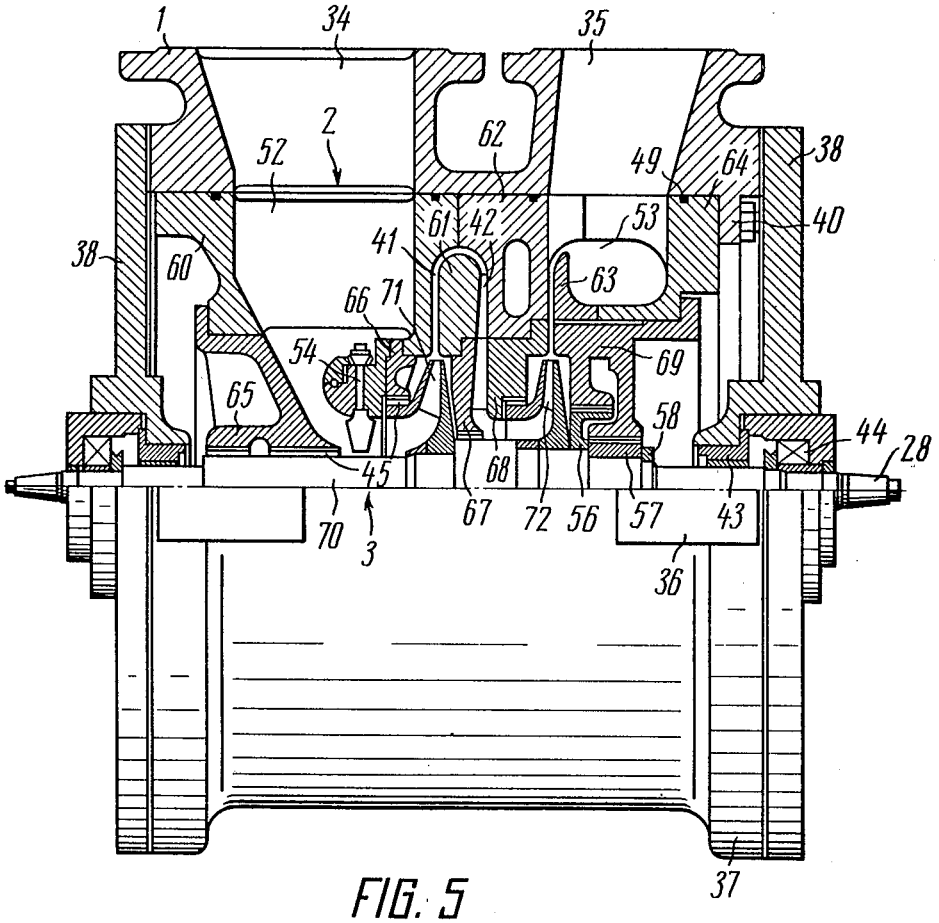
FIG. 5 shows the two-stage centrifugal compressor with a package of diaphragms wherein the holes for the labyrinth seal holders have diameters increasing in steps towards the end of the diaphragm package.
Figure 6:
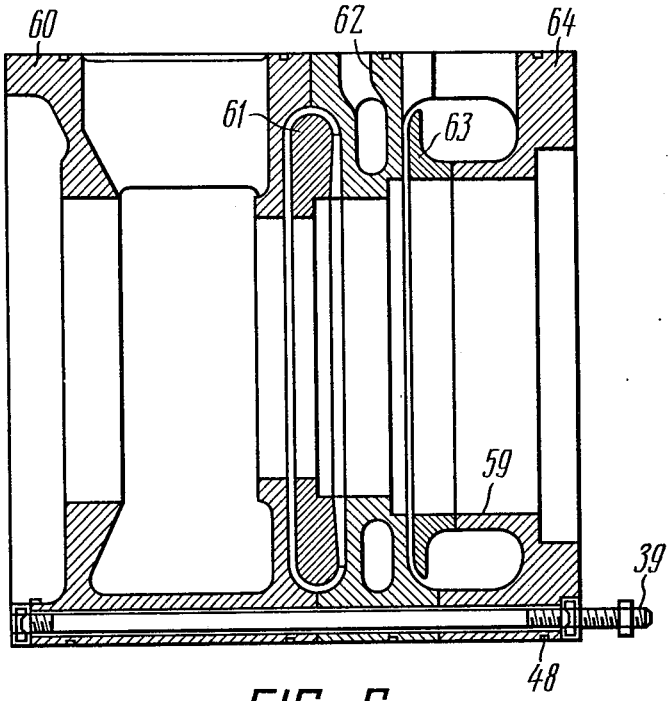
FIG. 6 is a longitudinal section through the diaphragm package of the two-stage centrifugal compressor according to the invention.

In case of a centrifugal compressor with a small number of compression stages, such as illustrated in FIG. 5, it is expedient that the cylindrical holes 59 (FIG. 6) in the diaphragms 60 – 64 for the holders 65 (FIG. 5), 66, 67, 68, 69 should have diameters increasing in steps toward one of the package ends, say, to the right-hand end. This affords some technological advantages, viz., simpler machining of the stepped recess in the package.

The design of the centrifugal compressor illustrated in FIG. 5 is similar to that shown in FIG. 1 and this compressor is assembled similarly to the procedure described above, i.e. by consecutive installation of the impellers 71, 72 on the shaft 70 and of the holders 65 – 69 into the diaphragm package 60 – 64, in the order of the increasing diameters of the cylindrical holes 59 (FIG. 6) from the smaller to the larger diameter towards one of the package ends, e.g. to the right-hand end.

What is claimed is:

1. A multiple-stage centrifugal compressor without the horizontal joint comprising a casing; diaphragms interconnected into a package and forming a stator accommodated in said casing; stage impellers; a shaft mounting said stage impellers and constituting a rotor; labyrinth seal holders; said diaphragms have cylindrical holes for said labyrinth seal holders; the improvement of said compressor consists in that said cylindrical holes in the diaphragms have different diameters along the shaft axis, said diameters increasing in steps towards the end of the diaphragm package whereby said labyrinth seal holders are adapted to be inserted and/or removed from said one end of said diaphragm package.

2. A multiple-stage centrifugal compressor without the horizontal joint comprising a casing; diaphragms interconnected into a package and forming a stator accommodated in said casing; stage impellers; a shaft mounting said stage impellers and constituting a rotor; labyrinth seal holders; said diaphragms have cylindrical holes for said labyrinth seal holders; the improvement of said compressor consists in that the hole for the labyrinth seal holders located along the shaft axis in the middle of the diaphragm package has the smallest diameter while all the other holes for the labyrinth seal holders have diameters increasing in steps toward both ends of the diaphragm package whereby said seal holders are adapted to be inserted and/or removed from the ends of said diaphragm package.

* * * * *